United States Patent [19]

Mizuguchi et al.

[11] Patent Number: 4,482,447

[45] Date of Patent: Nov. 13, 1984

[54] NONAQUEOUS SUSPENSION FOR ELECTROPHORETIC DEPOSITION OF POWDERS

[75] Inventors: Jin Mizuguchi, Yokohama; Koichiro Sumi, Kouriyama; Tsuneo Muchi, Kawasaki; Shinichi Soyama, Chiba, all of Japan

[73] Assignee: Sony Corporation, Tokyo, Japan

[21] Appl. No.: 531,739

[22] Filed: Sep. 13, 1983

[30] Foreign Application Priority Data

Sep. 14, 1982 [JP] Japan ..... 57-160252

[51] Int. Cl.[3] ..... C25D 13/02; C25D 13/10

[52] U.S. Cl. ..... 204/181 N; 204/181 R; 313/467

[58] Field of Search ..... 204/181 N, 181 R; 313/467; 536/62

[56] References Cited

U.S. PATENT DOCUMENTS

| | | | |
|---|---|---|---|
| 3,070,441 | 12/1962 | Schwartz | 204/181 N |
| 3,163,592 | 12/1964 | Dolan et al. | 204/181 N |
| 3,551,306 | 12/1970 | Grosso et al. | 204/181 N |

FOREIGN PATENT DOCUMENTS 0005662 2/1980 Japan .

*Primary Examiner*—John F. Niebling
*Assistant Examiner*—B. J. Boggs, Jr.
*Attorney, Agent, or Firm*—Hill, Van Santen, Steadman & Simpson

[57] ABSTRACT

Nonaqueous suspension for electrophoretic deposition of powders is disclosed which includes suspension consisting of ketonic solvent, nitrocellulose dissolved therein and powders suspended therein, strong acid, and strong base. In this case, the strong acid and the strong base both are added to the suspension such that conductivity of the suspension becomes 1 to 30 $\mu$ ℧/cm.

8 Claims, 4 Drawing Figures

NONAQUEOUS SUSPENSION FOR ELECTROPHORETIC DEPOSITION OF POWDERS

BACKGROUND OF THE INVENTION

1. Field of the Invention

The present invention relates generally to nonaqueous suspensions for electrophoretic deposition of powders. More particularly, this invention relates to nonaqueous suspensions for electrophoretic deposition of powders adapted for use with electrophoretic deposition of various powders such as phosphor powders for making a finely patterned color phosphor screen of a cathode ray tube, cathode material powders for the cathode of the cathode ray tube, insulating powders such as alumina or the like on a filament surface used in an indirect heating cathode of the cathode ray tube and powders for passivation of the surface of semi-conductor devices, for example, passivation films in the grooves of mesa semi-conductor devices.

2. Description of the Prior Art

For the electrophoretic deposition of powders in nonaqueous solution as described above, an electrophoretic deposition of powders in nonaqueous solution which performs a so-called anodic deposition by suspension in which nitrocellulose is dissolved into a ketonic solvent into which powders are mixed is disclosed in, for example, Japanese Examined patent application publication No. 20431/1975, Japanese Unexamined patent application publication No. 118363/1978 and so on. According to such electrophoretic deposition of powders in nonaqueous solution, superior powder deposition can be carried out as compared with a so-called cathodic deposition employing a conventional aqueous suspension for electrophoretic deposition.

Such a case in which a color phosphor screen is deposited on the glass panel of a cathode ray tube according to electrophoretic deposition will be described. In this case, a transparent electrode with a pattern corresponding to a depositing pattern of phosphor or electrode pattern made of, for example, $In_2O_3$ or $SnO_2$: Sb is formed in advance on the inner surface of a glass panel and then the electrophoretic deposition of phosphor powders is carried out on this transparent electrode pattern. However, according to a conventional electrophoretic deposition of powders in aqueous solution, $H_20$ contained in the suspension is decomposed to $H^+$ and $OH^-$ in parallel with the powder deposition so that $H^+$ is moved to the transparent electrode which is applied with the negative potential and serves as a member to be electrophoretically deposited and that $H^+$ reacts with the transparent electrode to thereby develop or form hydrogen gas. By the gas evolution, a pin hole is caused in the phosphor powder layer thus electrophoretically deposited or the surface thereof is roughened or made coarse, that is the packing density of the phosphor layer is reduced. Further the transparent oxide electrode is reduced to degrade the electric characteristic thereof or the transparent electrode is browned. Moreover, electrolysis of water occurs in addition to the electrophoretic deposition so that current efficiency is low and it takes considerable time to obtain a phosphor layer of significant thickness. Further, metallic ions of metallic salts added to the suspension are electrophoretically deposited together with the powders, for example, $Al_2O_3$, thus causing insufficient insulation. Also, the above metallic ions work as a killer for the electrophoretic-deposited phosphor layer to lower the brightness thereof.

On the other hand, according to the electrophoretic deposition of powders in nonaqueous solution, the suspension contains almost no water. Even if the suspension contains water, since the anodic deposition method is used, namely, the electrode to be electrophoretically deposited is supplied with positive potential, $H^+$ generated by the electrolysis of water is moved to the opposite electrode, thus causing no undesirable phenomenon as mentioned above.

Although the electrophoretic deposition of powders in nonaqueous solution has many advantages as described above, in practice, this type of suspension is unstable (i.e. it had a short pot life) and its reproducibility was poor. These constitute the obstacles for the wide use of this kind of the electrophoretic deposition of powders in nonaqueous solution.

OBJECTS AND SUMMARY OF THE INVENTION

Accordingly, it is an object of the present invention to provide a nonaqueous suspension for electrophoretic deposition of powders which can remove the above defects inherent in the conventional nonaqueous suspension for electrophoretic deposition of powders.

It is another object of the present invention to provide a nonaqueous suspension for electrophoretic deposition of powders capable of performing the deposition having excellent stability and reproducibility.

According to one aspect of the present invention, there is provided a nonaqueous suspension for electrophoretic deposition of powders comprising:

suspension consisting of ketonic solvent, nitrocellulose dissolved therein and powders suspended therein;

strong acid; and strong base, said strong acid and said strong base both being added to said suspension such that conductivity of said suspension becomes 1 to 30 $\mu$ ʊ/cm.

The other objects, features and advantages of the present invention will become apparent from the following description taken in conjunction with the accompanying drawings through which the like references designate the same elements and parts.

DETAILED DESCRIPTION OF THE PREFERRED EMBODIMENTS

The present invention will hereinafter be described in detail with reference to the attached drawings.

Figure 1:
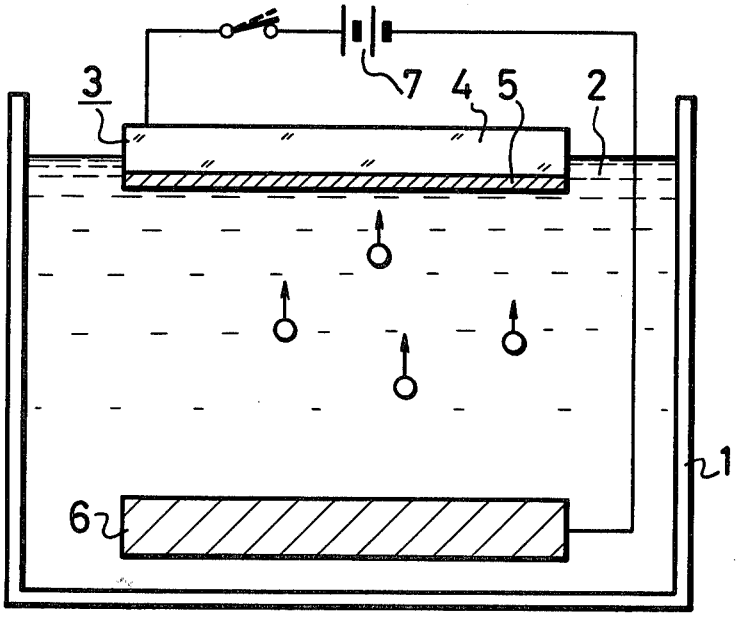
FIG. 1 is a diagram showing an apparatus which carries out the electrophoretic deposition of powders using the nonaqueous suspension for electrophoretic deposition of powders according to the present invention.

According to the present invention, the electrophoretic deposition in nonaqueous solution, namely, so-called anodic deposition is carried out which employs a nonaqueous suspension comprising suspension consisting of ketonic solvent, nitrocellulose dissolved therein, and powders suspended therein, strong acid and strong base. The conductivity of this suspension is then selected to be in a range from 1 to 30 $\mu$ ℧/cm so that the electrophoretic electric field between the electrodes in the suspension, or the potential gradient in the plating cell may become a predetermined one and also the abrupt gradient sufficient for deposition may be brought about at the electrode interfaces. Example According to the present invention, as shown in FIG. 1, nonaqueous suspension 2 having special composition, which will be described later is filled into a pot 1. In this suspension 2 is immersed an article 3 for coating of powders, for example, a panel of a cathode ray tube which will be subject to the deposition of powders such as phosphors. On this article for coating of powders is previously formed a transparent electrode made of, for example, $In_2O_3$ and so on with a pattern of phosphor to be deposited. As, for example, shown in FIG. 2, $In_2O_3$ is vacuum-deposited on the whole surface of a glass plate 4 and then photoetched to form a transparent electrode 5 of a stripe pattern. Then, a counter electrode 6, for example, aluminium electrode is immersed into the suspension 2 so as to oppose the article 3 for coating of powders on which the transparent electrode 5 is formed. And, a DC power source 7 is connected between the electrodes 5 and 6 such that the article for coating of powders, namely, the transparent electrode 5 is selected to be positive to thereby carry out the anodic deposition.

The solvent of the suspension 2 can be a mixed liquid of ketonic solvent such as acetone, methyl ethyl ketone (MEK), diethyl ketone, methyl isobutyl ketone (MIBK) and di-isobutyl ketone (DIBK) with diacetone alcohol, a mixed liquid solution of acetone and isopropyl alcohol, a mixed solution of acetone and toluene and so on.

A variety of powders can be anodically deposited uniformly using the same composition. For example, when a phosphor layer is deposited, various phosphors such as $Y_2O_3$:Eu, $Y_2O_2S$:Eu, $Y_2O_2S$:Tb, CaS:Ce, other ZnS-based phosphor such as ZnS:Cu,Al, ZnS:Ag or black and white phosphor are similarly deposited. When an insulating material is deposited on, for example, a filament, alumina powders $Al_2O_3$ can be employed. And, when the cathode material is deposited, various powders (Ba, Sr, Ca)$CO_3$, MgO and $LaB_6$ or the like can be used.

In the powder deposition in the groove of mesa semiconductor devices, powders such as $SiO_2$, SiO, polycrystalline or amorphous Si, $Si_3N_4$ and so on can be employed, and other powders such as ZnO, $Ti0_2$, WC, W, Mo, Ni, Al, phthalocyanine pigment, carbon black and so on can be employed.

The base to be added to the suspension can be tetramethyl ammonium hydroxide $(CH_3)_4NOH$ (hereinafter be abbreviated as TMAH), tetra-alkyl ammonium hydroxide $(CnH_{2n+1})_4NOH$ or potassium hydroxide KOH, sodium hydroxide NaOH and so on.

And finally, the strong acid to be added to the suspension can be sulfuric acid $H_2SO_4$ and/or phosphoric acid $H_3PO_4$.

The standard composition of the suspension is selected as follows:

| | |
|---|---|
| acetone | 500 ml |
| nitrocellulose (dispersant) | 1.2 g |
| TMAH (10 weight percent aqueous solution) | 60 $\mu$l |
| sulfuric acid | about 4 $\mu$l |
| powder (the average particle diameter thereof is approximately 5 $\mu$m) | 100 g |

As the average diameter of powder is increased, it is necessary to increase the amount of nitrocellulose and the concentration of powders. The deposition condition is that the applied voltage is selected in a range from, for example, 20 to 800 V(DC) and the current density is selected in a range from 1.6 to 2.5 mA/cm$^2$. Under this condition, it takes 0.5 seconds to deposit a layer of 100 $\mu$m thickness.

The reason why the base is added to the suspension is mainly to give the conductivity to the suspension, which can present a predetermined potential gradient, namely, a potential gradient for electrophoresis necessary for mass transfer, between the electrodes 5 and 6 and present a more abrupt potential gradient sufficient for deposition than one above in the vicinity of the electrodes 5 and 6. And, the addition of the strong acid controls the surface charge of the powder particles. When both of the base and strong acid are added to approximately neutralize the suspension, in other words, the pH value is selected in a range from 1 to 7, the deposition can be carried out well. The above values of pH of the suspension is measured under the condition that the suspension is left for five minutes. And, if the amount of the above base and strong acid added to the suspension is too large, sediment is caused in the suspension. Therefore, both of the base and strong acid are desired to have a low concentration to some extent. The conductivity thereof is selected to be in a range from 1 to 30 $\mu$ ℧/cm under which conductivity, the predetermined potential gradient sufficient for electrophoresis is generated between both the electrodes 5 and 6 and also the predetermined electric field having the more abrupt potential gradient sufficient for deposition than one necessary for mass transfer is obtained at the interfaces of the electrodes 5 and 6. Namely, the reason why the conductivity is selected to be in a range from 1 to 30 $\mu$ ℧/cm is as follows: if the conductivity is selected lower than 1 $\mu$ ℧/cm the predetermined electric field can not be obtained between the electrodes 5 and 6. And, if it exceeds 30 $\mu$ ℧/cm, the resistance of the suspension is lowered too much so that the electric field is concentrated at the interfaces of the electrodes 5 and 6, and the electrophoresis can not be carried out.

EXAMPLE 1

Alumina was deposited on the filament using the suspension having the composition below:

| | |
|---|---|
| acetone | 500 cc |
| nitrocellulose (product name, RS60 and manufactured by Daicel Ltd. the degree of polymerization is 720) | 1.25 g |
| $\alpha$ - $Al_2O_3$ | 100 g |
| TMAH (10 weight percent aqueous solution) | 60 $\mu$l |

-continued

| | |
|---|---|
| $H_2SO_4$ | 4 μl |

And, the applied voltage was selected as 400 V. In this case, the alumina layer having the thickness of 140 μm was deposited on the filament for one second.

EXAMPLE 2

Cathode material was deposited under the applied voltage of 300 V, using the suspension having the composition expressed below:

| | |
|---|---|
| methyl ethyl ketone (MEK) | 500 cc |
| nitrocellulose (product name, RS-20 and manufactured by Daicel Ltd. the degree of polymerization is 580) | 3 g |
| (Ba, Sr, Ca)$CO_3$ | 150 g |
| KOH (1 mol solution) | 45 μl |
| $H_2SO_4$ | 5 μl |

In this case, the cathode material layer having the thickness of 140 μm was similarly deposited for about one second.

EXAMPLE 3

Phosphor material was deposited at 500 V, using the suspension having the composition expressed are:

| | |
|---|---|
| methyl isobutyl ketone (MIBK) | 500 cc |
| nitrocellulose (product name, RS-120 and manufactured by Daicel Ltd. the degree of polymerization of which is 830) | 3.5 g |
| ZnS:Cu, Al | 50 g |
| TMAH (10 weight percent methanol solution) | 80 μl |
| $H_2SO_4$ | 20 μl |

In this case, the phosphor layer having the thickness of 140 μm was deposited for about one second.

EXAMPLE 4

Red phosphor material was deposited at 200 V, using the suspension formed by mixing acetone and toluene with a mixing ratio of 1:1 having the composition expressed below:

| | |
|---|---|
| mixed solvent | 500 cc |
| nitrocellulose (RS-20) | 2 g |
| $Y_2O_3$:Eu (phosphor) | 200 g |
| NaOH (1 mol solution) | 100 μl |
| $H_3PO_4$ | 15 μl |

Thus, the phosphor layer was obtained. In this case, the deposition rate at that time was approximately the same as that in the example 1.

EXAMPLE 5

The deposition of phosphor was carried out. In this case, the suspension had the composition expressed below:

| | |
|---|---|
| mixed solvent of diisobutyl ketone (DIBK) and diacetone alcohol | 500 cc |
| nitrocellulose (product name, RS-½ and manufactured by Daicel Ltd. the degree of polymerization of which is 190) | 2 g |
| ZnS:Cu, Al (phosphor) | 100 g |
| TMAH (ten weight percent aqueous solution) | 30 μl |
| $H_2SO_4$ | 6 μl |

Then, the electrophoretic deposition was carried out at 500 V, employing the above suspension.

EXAMPLE 6

The deposition of phosphor was carried out at 100 V using the suspension having the composition expressed below:

| | |
|---|---|
| acetone | 500 cc |
| nitrocellulose (RS-20) | 2 g |
| white phosphor formed by mixing three kinds of ZnS:Ag, ZnS:Au, Al and $Y_2O_2S$:Eu | 250 g |
| TMAH (1 mol solution) | 50 μl |
| $H_3PO_4$ | 8 μl |

EXAMPLE 7

The deposition was carried out at 600 V, using the suspension having the composition expressed below:

| | |
|---|---|
| MEK | 500 cc |
| nitrocellulose (RS-60) | 1.5 g |
| CaS:Ce | 80 g |
| TMAH (ten weight percent aqueous solution) | 100 μl |
| $H_2SO_4$ | 10 μl |

EXAMPLE 8

The deposition was carried out at 80 V, using the suspension having the composition expressed below:

| | |
|---|---|
| mixed solvent of acetone and MEK | 500 cc |
| nitrocellulose (RS-120) | 5 g |
| white phosphor formed by mixing ZnS:Ag, $Y_2O_2S$:Tb and $Y_2O_2$:Eu | 250 g |
| NaOH (1 mol solution) | 80 μl |
| $H_3PO_4$ | 12 μl |

Figure 3:
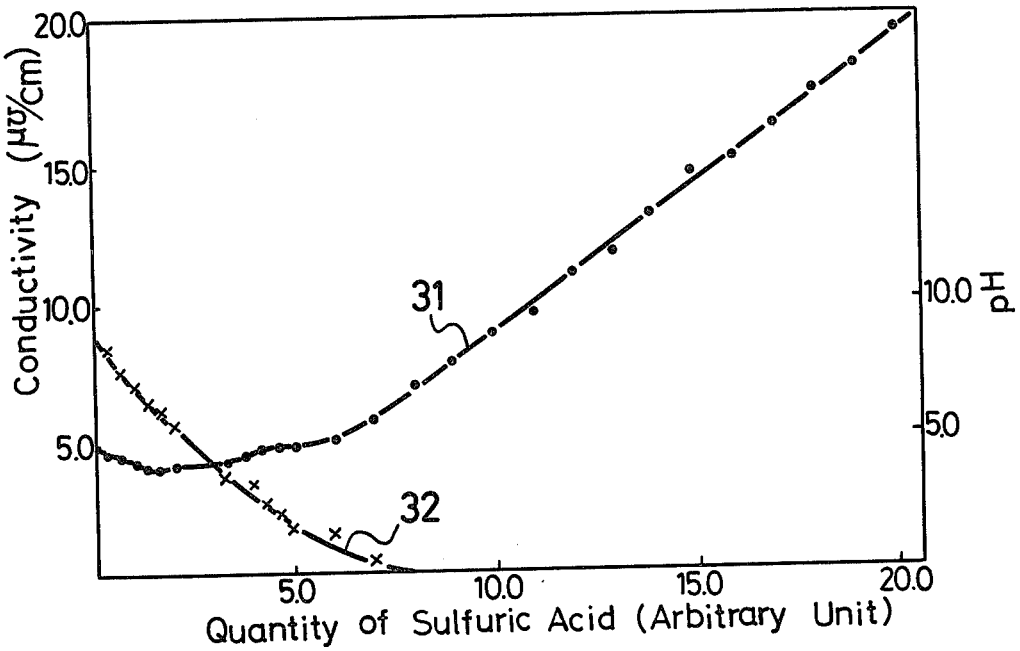
FIG. 3 is a graph showing the relation between the conductivity and pH values when a weighted amount of sulfuric acid is added to the nonaqueous suspension for electrophoretic deposition of powders according to the present invention.
Figure 4:
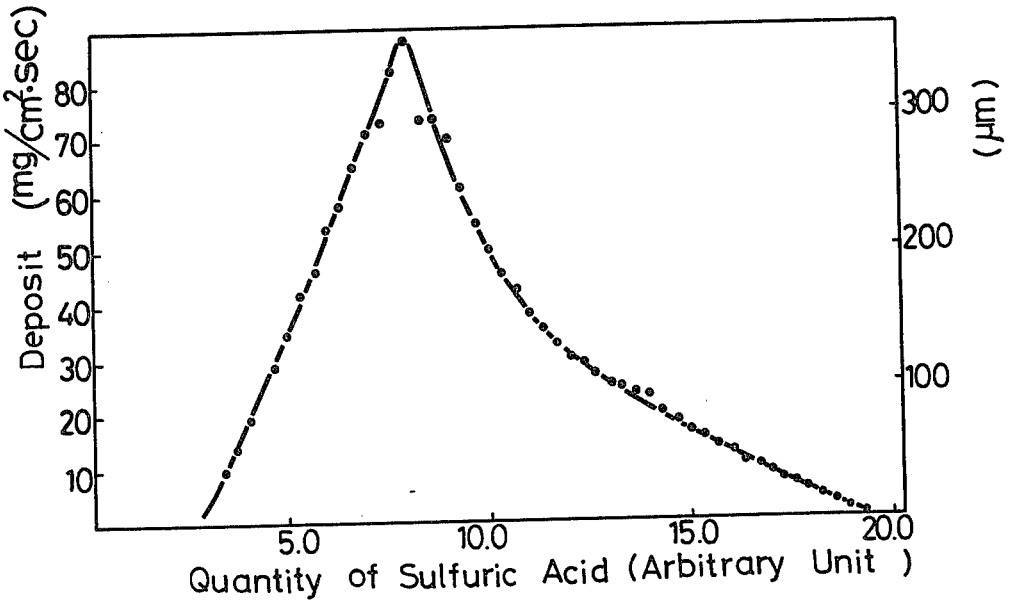
FIG. 4 is a graph similarly showing the relation between the amount of deposit and an axount of sulfuric acid added to the suspension.

FIG. 3 is a graph indicating measured results of each relation between the conductivity (curve 31) and the pH values (curve 32) of the suspension having the composition of Example 1 when the quantity of sulfuric acid added thereto is changed. Meanwhile, FIG. 4 is a graph indicating measured results of each relation between the amount of deposit and the amount of sulfuric acid added. In this case, the deposition was carried out at 500 V for one second. Although the quantity of sulfuric acid changes depending on the kinds of powders, the quantity of sulfuric acid indicates the approximately common tendency with respect to each example so that it is indicated as a relative value. It was ascertained that the condition under which the satisfactory deposition could be carried out was that the conductivity of the suspension was selected in a range from 1 to 30 μ℧/cm and the pH thereof was selected in a range from 1 to 7.

Figure 2:
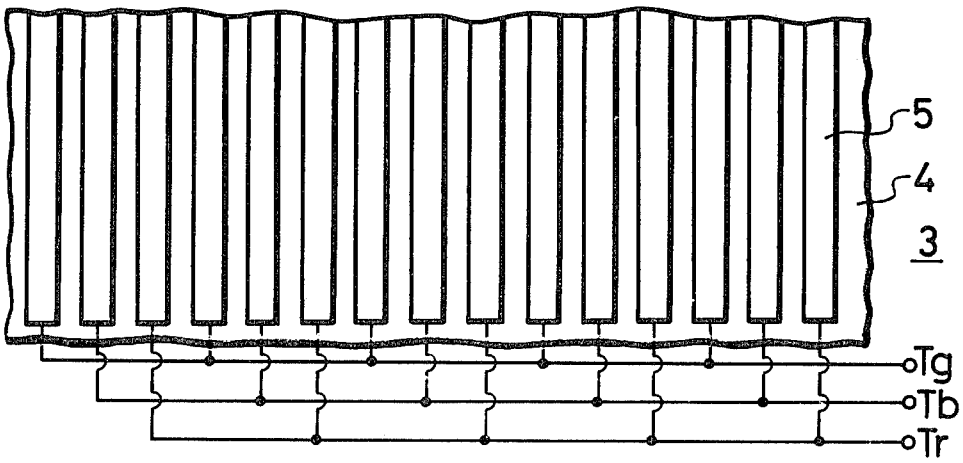
FIG. 2 is a diagram showing an electrode pattern in the case where the nonaqueous suspension for electrophoretic deposition of powders according to the present invention is used for forming a color phosphor screen.

When a color phosphor screen is formed by using the suspension according to the present invention, every third electrodes, for example, of the stripe-pattern electrodes 5 shown in FIG. 2 are connected and then terminals Tr, Tg and Tb are led out from three pairs of the electrode groups, respectively. Using the suspension 2 into which red phosphor powders are suspended, the power source 7 is inserted between the terminal Tr led out from the one pair of the electrode groups and the counter electrode 6 to thereby carry out the deposition whereby the red phosphors are selectively deposited on the stripe-pattern electrodes of every third electrodes 5. Then, using the suspension 2 into which green phosphor powders are suspended, the powder source 7 is inserted between the terminal Tg led out from the another pair of the electrode groups and the counter electrode 6 to thereby carry out the deposition whereby the green phosphors are selectively deposited on the stripe-pattern electrodes of another every third electrodes 5. Subsequently, using the suspension 2 into which blue phosphor powders are suspended, the power source 7 is inserted between the terminal Tb led out from the other pair of the electrode groups and the counter electrode 6 to thereby carry out the deposition whereby the blue phosphors are selectively deposited on the stripe-pattern electrodes of the other every third electrodes 5. As a result, the color phosphor screen is formed in which the red, green and blue phosphors are respectively deposited on every third stripe-shaped electrodes.

According to the nonaqueous suspension for electrophoretic deposition of powders, the deposited film is dense, the distribution of the particle diameter along the thickness direction of the deposited layer is uniform, and its surface is smooth. Also, the filament, the base-metal or the transparent electrode and so on of, for example, the cathode ray tube as its plating electrode are not damaged, the degree of freedom in selecting the plating electrode material becomes large and the deposition of various kinds becomes possible. In addition, impurity is hardly mixed into the deposit layer so that the deposit layer of high purity can be obtained.

Moreover, since the deposition is performed with high efficiency by the invention, the deposition which takes three minutes using the conventional aqueous suspension for electrophoretic deposition of powders can be carried out for 0.3 seconds.

Furthermore, particularly in accordance with the present invention, the deposition having excellent stability and reproducibility can be carried out, and as compared with poor pot life in the prior art which is limited to the use of only several times, the pot life of the present invention can be extended to the use of several hundred times.

The above description is given on the preferred embodiments of the invention, but it will be apparent that many modifications and variations could be effected by one skilled in the art without departing from the spirits or scope of the novel concepts of the invention, so that the scope of the invention should determined by the appended claim only.

We claim as our Invention:

1. Nonaqueous suspension for electrophoretic deposition of powders comprising:

suspension consisting of ketonic solvent, nitrocellulose dissolved therein and powders suspended therein;

strong acid; and strong base, said strong acid and said strong base both being added to said suspension such that conductivity of said suspension becomes 1 to 30 $\mu$ ℧/cm.

2. A suspension according to claim 1 wherein the pH of the suspension is in the range from 1 to 7.

3. A suspension according to claim 1 wherein said powders are cathode ray tube phosphors.

4. A suspension according to claim 1 wherein said powders have an average particle diameter of about 5 microns.

5. A suspension according to claim 1 wherein said base is a tetra-alkyl ammonium hydroxide.

6. A suspension according to claim 1 wherein said base is an alkali metal hydroxide.

7. A suspension according to claim 1 wherein said acid is sulfuric acid.

8. A suspension according to claim 1 wherein said acid is phosphoric acid.

* * * * *